US007241170B1

(12) United States Patent
Lindner et al.

(10) Patent No.: US 7,241,170 B1
(45) Date of Patent: Jul. 10, 2007

(54) PERMANENT TERMINATIONS OF NETWORK CABLES

(75) Inventors: Leonard Scott Lindner, Hudson, OH (US); Daniel Pellegrino, Ayden, NC (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/400,325

(22) Filed: Apr. 7, 2006

(51) Int. Cl.
*H01R 13/60* (2006.01)

(52) U.S. Cl. ..... 439/539; 439/536

(58) Field of Classification Search ..... 439/535, 439/536, 538, 539, 344, 540.1, 557; 174/53
See application file for complete search history.

(56) References Cited

U.S. PATENT DOCUMENTS

| | | | | | |
|---|---|---|---|---|---|
| 3,622,945 | A | * | 11/1971 | Winston et al. | 439/539 |
| 4,059,327 | A | * | 11/1977 | Vann | 439/535 |
| 4,379,605 | A | | 4/1983 | Hoffman | 439/107 |
| 4,721,476 | A | * | 1/1988 | Zeliff et al. | 439/142 |
| 4,854,885 | A | | 8/1989 | Bowden, Jr., et al. | 439/109 |
| 4,859,201 | A | | 8/1989 | Marsh | 439/290 |
| 4,874,904 | A | * | 10/1989 | DeSanti | 174/53 |
| 4,967,041 | A | * | 10/1990 | Bowman | 174/135 |
| 5,180,886 | A | | 1/1993 | Dierenbach et al. | 174/66 |
| 5,645,449 | A | * | 7/1997 | Sabo | 439/540.1 |
| 5,647,763 | A | | 7/1997 | Arnold et al. | 439/540.1 |
| 5,735,714 | A | * | 4/1998 | Orlando et al. | 439/676 |
| 5,741,158 | A | * | 4/1998 | Reed et al. | 439/536 |
| 6,422,898 | B1 | * | 7/2002 | Harvey et al. | 439/536 |
| 6,955,559 | B2 | | 10/2005 | Pyrros | 439/535 |
| 7,057,105 | B2 | * | 6/2006 | Gottardo et al. | 174/50 |
| 2004/0238197 | A1 | * | 12/2004 | Gates | 174/53 |

* cited by examiner

*Primary Examiner*—Ross Gushi
(74) *Attorney, Agent, or Firm*—BainwoodHuang

(57) ABSTRACT

An improved bracket is utilized in a mounting system for a modular system connector used in connecting devices to cables such as network cable, coaxial cable, or fiber optic cable. The bracket has a pair of mounting portions for securing to an outlet box and a modular receiving portion for receiving a modular connector. The modular receiving portion is located in the outlet box and angled downward to allow the connection of the cable at such an angle and position that it can connect to a flush mounted device. Accordingly, the modular connector is not flush or projecting from the outlet such as in conventional devices and therefore is not required to be removed from its mounting in order to mount a flush mounted device such as a voice over IP telephone.

19 Claims, 7 Drawing Sheets

PERMANENT TERMINATIONS OF NETWORK CABLES

BACKGROUND

In the construction of both commercial and residential spaces, it is common to pre-wire spaces. Years ago, the pre-wiring was for telephones that were POTS (plain old telephone system) telephones. These previous systems did not have strenuous system requirements related to the interior wiring. In the current environment, locations are pre-wired for computers, telephone, video, and other items. The pre-wiring cables can include coaxial, network, such as CAT 5 (5th generation of twisted pair Ethernet cabling), or fiber optic cable. These cables typically extend from a distribution center at a central location having a rack with a series of boxes to an outlet having a modular jack. The cable is secured at both ends within a box and at a modular jack respectively. It is common to have cables terminated at locations that are not currently being used.

With certain systems and cables such as network cabling for computer systems/internet connectivity, the ends need to be held in a rigid location to maintain certification. The cable is secured go to a plate at the outlet that places the modular jack flush with the wall or projecting slightly outward.

SUMMARY

It is recognized that current devices or components such as wall-mounted telephones need to be mounted flush to the wall. One of the issues with the mounting of the device flush with the wall in the conventional method is the location of the connection cable. While the device may have a small cavity to receive a portion of the cable, the cable needs to be fitted between the wall and the device and likely will have a tight radius on the cable to fit within this space. The quality of the signal within the cable is denigrated if the cable has too tight of a radius.

One conventional method of fixing the situation is to disconnect the modular connector from the outlet box and allow the cable and connector to move around within the box. However, this movement of the modular connector and the cable results in loss of certification that a certain data rate will be met.

In contrast to the above-described method of addressing the issue of mounting a wall mounted device, an improved technique uses an improved bracket in a mounting system to position a modular system connector used in connecting devices to cables such as network cabling, coaxial cable, or fiber optics cable. The bracket has a pair of mounting portions for securing to an outlet box and a modular receiving portion for receiving at least one modular connector. The modular receiving portion is located in the outlet box and is angled downward to allow the connection of the cable at such an angle and position that it can connect to a flush mounted device. Accordingly, the modular connector is not flush or projecting from the outlet such as in conventional devices and therefore is not required to be removed from its mounting in order to mount a flush mounted device such as a voice over IP telephone.

One embodiment is a bracket for retaining a modular connector in relation to an outlet box. The bracket has a pair of mounting portions. Each mounting portion has an opening for receiving a fastener for securing the bracket to the outlet box. The mounting portions define a wall surface plane. The bracket has a modular receiving portion interposed between the pair of mounting portions. The modular receiving portion has at least one modular receiving opening that receives the modular connector. The modular receiving portion with the modular opening is spaced from the wall surface plane and located in the outlet box such that the modular connector is located within the outlet box.

In an embodiment, the modular receiving portion defines a receiving plane that intersects the wall surface plane at an angle of between 30 degrees and 60 degrees. The receiving portion plane intersects the wall surface plane above the modular receiving opening so the modular connector opens downward to limit contamination.

In an embodiment, the modular receiving portion of the bracket has a plurality of breakable tabs extending into at least one modular receiving opening for adjusting the size of the opening for the modular connector. At least one of the mounting portions has a breakable tab for assisting in positioning the bracket relative to the outlet box and a wall.

In an embodiment, the opening for receiving a fastener of each mounting portion of the bracket has a plurality of slots allowing movement of the bracket relative to the outlet box. Each of the mounting portions of the bracket has a threaded opening for receiving a fastener for securing a device to the bracket and the outlet box.

In an embodiment, the bracket has at least one positioning portion interposed between the mounting portion and the modular receiving portion for positioning the modular receiving portion relative to the outlet box.

A mounting system for cable has an outlet box, a bracket, a modular connector, and a cable. The outlet box has a series of side walls and a pair of mounting flanges. Each mounting flange of the outlet box has a threaded mounting hole. The mounting flanges define a wall surface plane. The bracket has a pair of mounting portions and a modular receiving portion. Each mounting portion has an opening for receiving a fastener accepted by the threaded mounting hole of the mounting flanges of the outlet box. The bracket has a modular receiving portion interposed between the pair of mounting portions. The modular receiving portion has at least one modular receiving opening. The modular receiving portion with the modular opening is spaced from the wall surface plane and located in the outlet box such that the modular connector is located within the outlet box. The modular connector is received in the modular opening space of the modular receiving portion of the bracket. The modular connector is located within the outlet box. The cable extends into the outlet box and is connected to the modular connector In one embodiment, the device mounted to the bracket is a telephone such as a voice over IP telephone or a plain old telephone service (POTS) telephone using CAT5 cable. In another embodiment, the device is a wireless router. In another embodiment, the device is a camera connected with either co-axial cable or network cable such as CAT5 cable or CAT6 cable.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

An improved bracket is utilized in a mounting system for a modular system connector used in connecting devices to cables such as network cabling, such as CAT 5 (5th generation of twisted pair Ethernet cabling), coaxial cable, or fiber optic cable. The bracket has a pair of mounting portions for securing to an outlet box and a modular receiving portion for receiving a modular connector. The modular receiving portion is located in the outlet box and angled downward to allow the connection of the cable at such an angle and position that it can connect to a flush mounted device. Accordingly, the modular connector is not flush or projecting from the outlet such as in conventional devices and therefore is not required to be removed from its mounting in order to mount a flush mounted device such as a voice over IP telephone.

Figure 1:
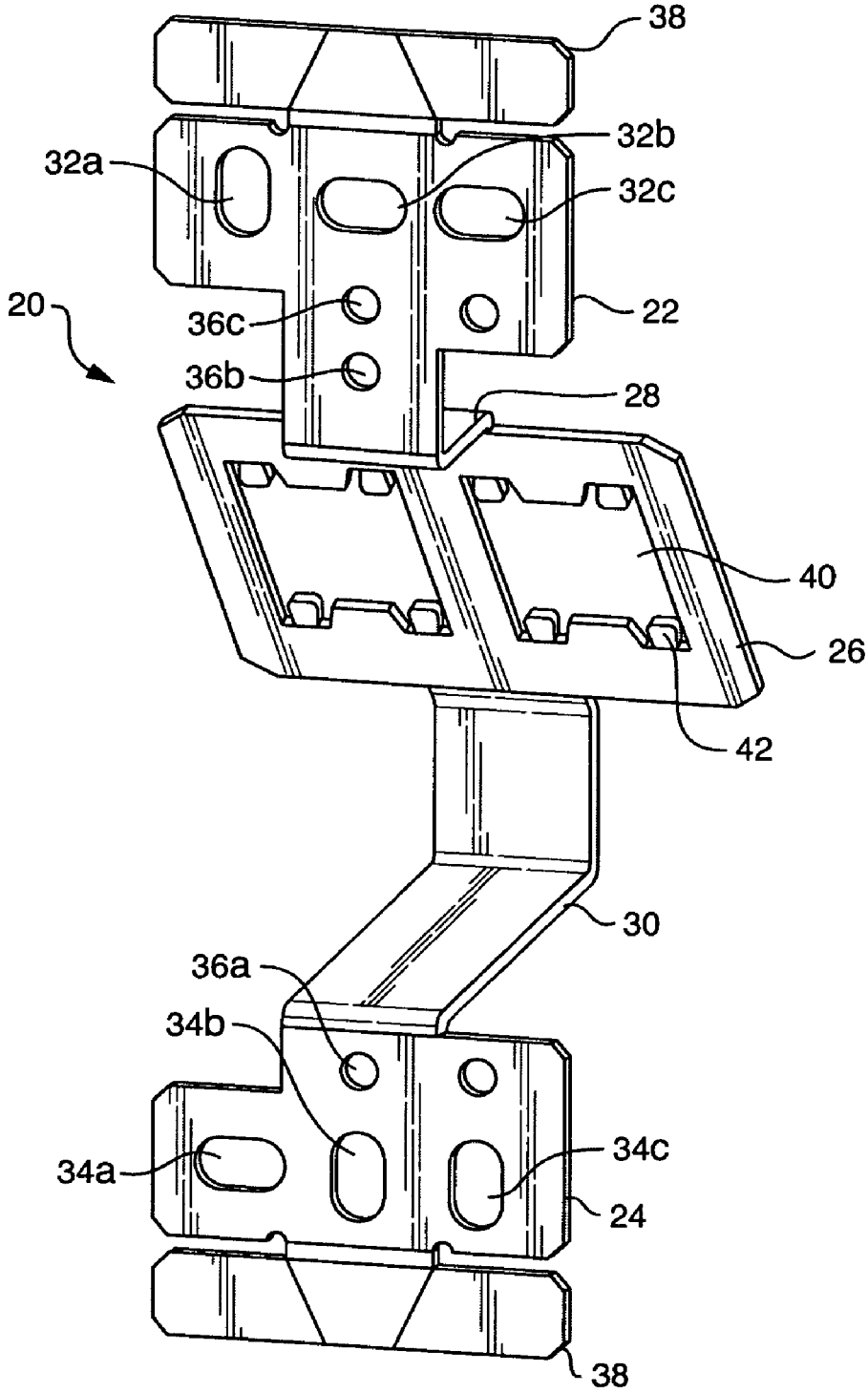
FIG. 1 is a perspective view of a bracket.

When referring to the drawing in the description which follows, like numerals indicate like elements. FIG. 1 shows a bracket 20 having a pair of mounting portions 22 and 24 and a modular receiving portion 26. Interposed between the top mounting portion 22 and the modular receiving portion 26 is an upper positioning portion 28. Interposed between the bottom mounting portion 24 and the modular receiving portion 26 is a lower positioning portion 30. The positioning portions 28 and 30 space and position the modular receiving portion 26 relative to the mounting portions 22 and 24 of the bracket 20.

The top mounting portion 22 of the bracket 20 has three mounting slots 32*a*, 32*b*, and 32*c*. The bottom mounting portion 24 of the bracket 20 has three mounting slots 34*a*, 34*b*, and 34*c*. In the embodiment shown, the mounting slots on the top mounting portion include a vertical orientated slot 32*a* and a pair of horizontal slots 32*b* and 32*c*. In the embodiment shown, the mounting slots on the bottom mounting portion 24 include a horizontal orientated slot 34*a* and a pair of vertical slots 34*b* and 34*c*.

In addition, still referring to FIG. 1, the mounting portions 22 and 24 each have at least one threaded hole 36. In FIG. 1, three threaded holes 36*a*, 36*b*, and 36*c* are shown. The mounting portions 22 and 24 of the bracket 20 each have a breakable tab 38 that has sub-portions that can be broken off.

The modular receiving portion 26 has a pair of generally rectangular openings 40. The modular receiving portion 26 has a series of tabs 42 that extend into each of the openings 40.

Figure 2:
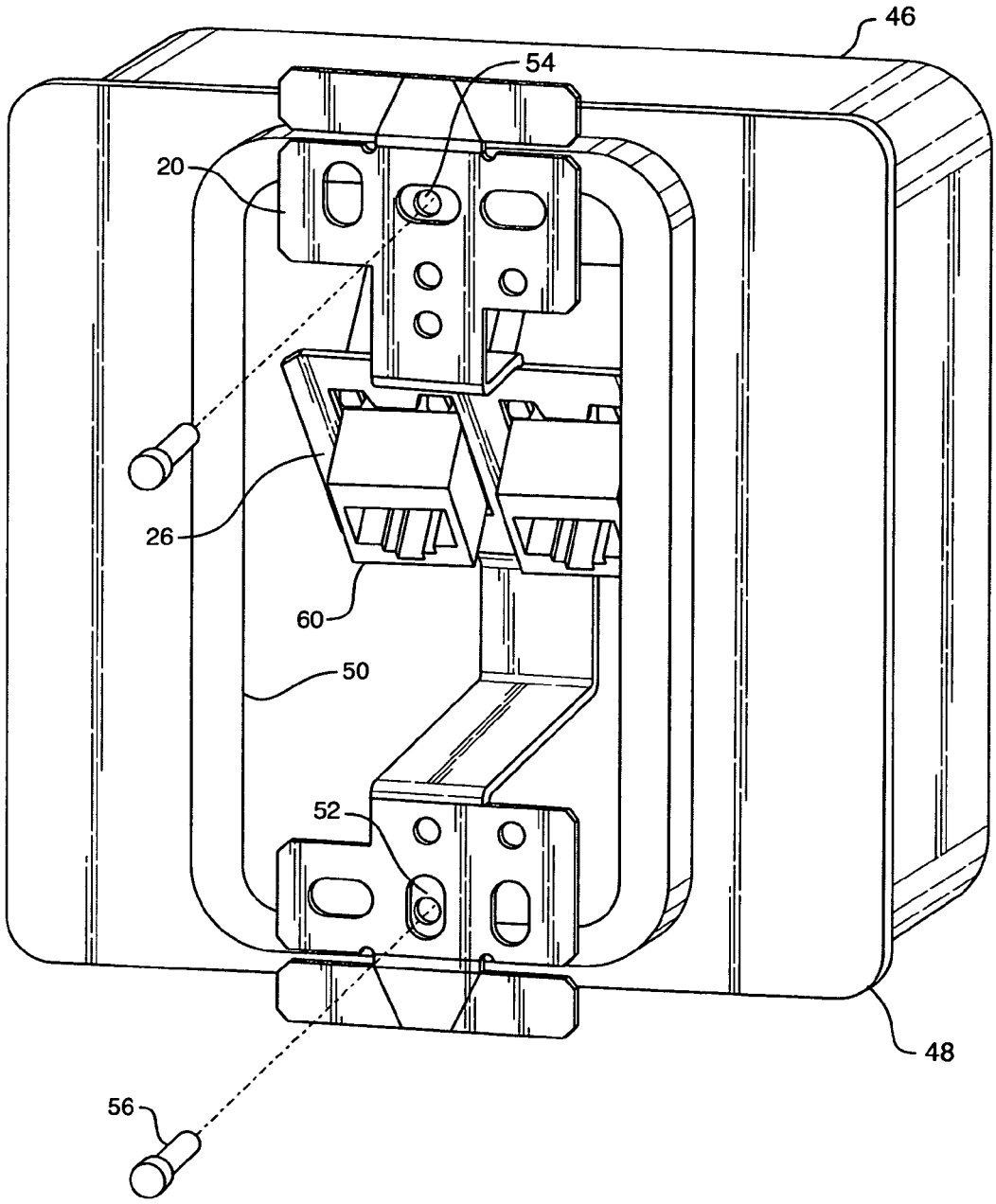
FIG. 2 is a perspective view of the bracket in an outlet box.

Referring to FIG. 2, an adapter cover 48 is secured to an outlet box 46; the adapter cover 48 is commonly called a mud ring. The adapter cover 48 has an opening 50 which is smaller than the opening on the 4 inch by 4 inch outlet box 46. The bracket 20 is secured to a pair of flanges 52 on the adapter cover 48 with a pair of fasteners 56 that are received into threaded holes 54 in the flanges 52. The modular receiving portion 26 of the bracket 20 is located within the outlet box 46. The modular receiving portion 26 has a pair of modular connectors 60. As can be seen, the modular connectors 60 are located in the outlet box 46 and do not protrude through the adapter cover 48. In particular, the modular connectors 60 are recessed well within the outlet box 46 thus enabling connecting bodies, such as a RJ45 plug to sit within the outlet body when connected to the modular connector 60. Such a configuration allows devices to physically mount over the outlet box 46 (e.g., a wall-mounted telephone) in a flush, clean, and un-cramped manner.

Figure 3:
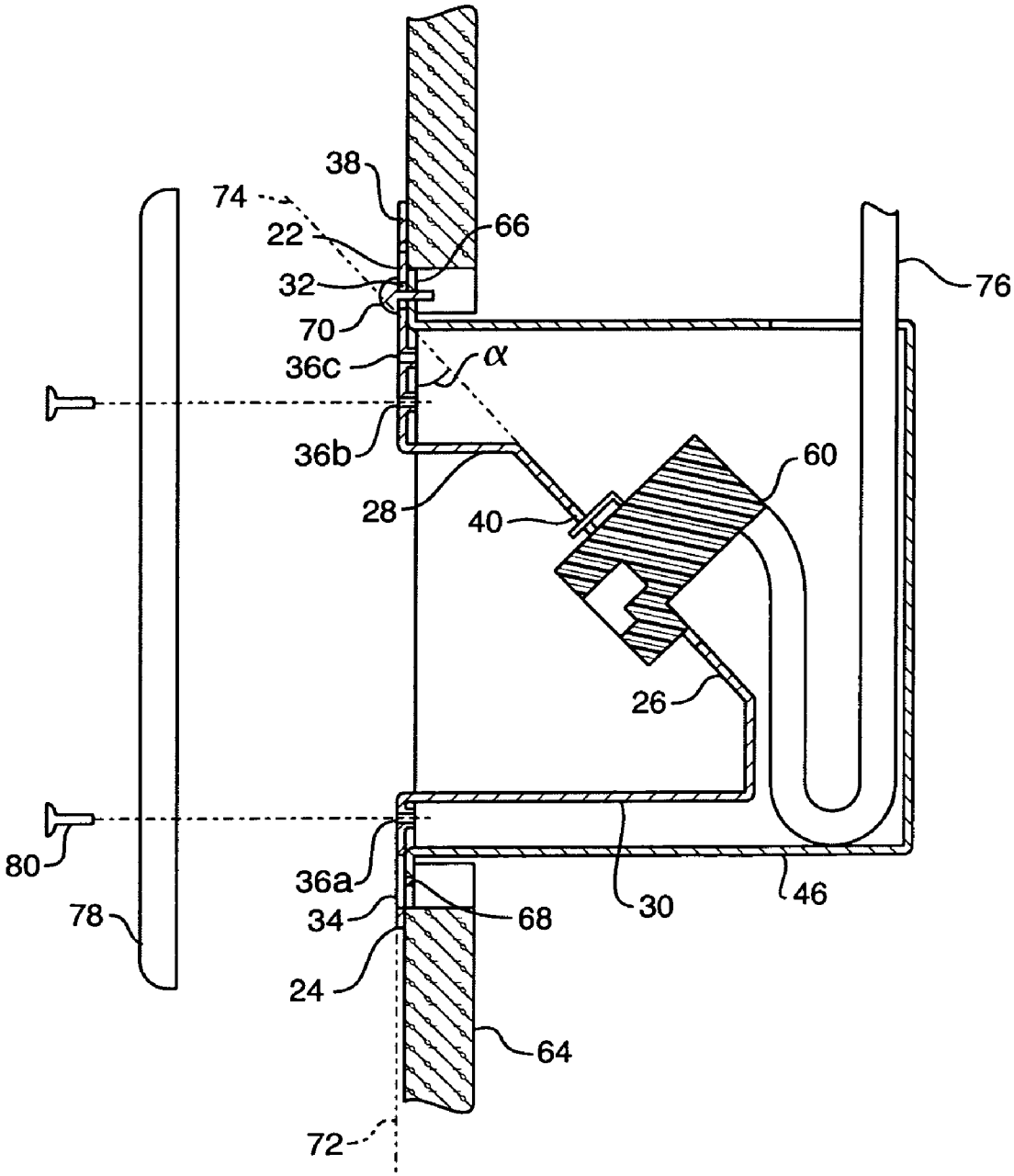
FIG. 3 is side sectional view of the bracket in the outlet box.

Referring to FIG. 3, a sectional view of an outlet box 46 in a wall with a wall board 64 is shown. The outlet box 46 has a pair of mounting flanges 66. Each mounting flange 66 has a threaded opening 68 in the mounting flanges 66 of the outlet box 46. The bracket 20 is mounted to the outlet box 46 by a pair of fasteners 70 that extend through one of the mounting slots 32 and 34 and are received by the threaded openings 68. The breakable tabs 38 are used to assist in positioning the bracket 20 relative to the wall 64.

The mounting portions 22 and 24 of the bracket 20 define a wall surface plane 72. The modular receiving portion 26 of the bracket 20 is to the right of the wall surface plane 72 in the Figure and located in the outlet box 46. The modular receiving portion 26 receives the modular connectors 60 in the rectangular openings 40. The tabs 42, as seen in FIG. 1, are breakable to adjust the size of the opening 40 to the size of the modular connector 60. The bracket 20 and the modular connectors 60 are configured and sized such that the entire modular connector 60 is located in the outlet box 46. A cable 76 from a distribution center is shown entering the outlet box 46 from above in the wall.

In one arrangement, the tabs 42 and opening 40 are sized such that the tabs 42 are left on or broken off to coincide with modular connector height of 0.760 inches, 0.775 inches, or 0.790 inches.

Still referring to FIG. 3, a face plate 78 is shown exploded away from the outlet box 46. The outlet box 46 has a series of side walls, a back wall, and an opening that is generally parallel to the opening in the wall 64. The face plate 78 covers the outlet box 46 when the outlet box 46 and the modular connector 60 are not being used. The face plate 78 is secured to the outlet box 46 and the wall 64 with a pair of fasteners 80 that are received by the threaded holes 36*a* and 36*b* in the bracket 20. The bracket 20 does not need to be removed from the outlet box 46 to install and remove the face plate 78 in that the fasteners 80 are distinct from the fasteners 70 and the slots 32 and 34 that are used in mounting the bracket 20 to the outlet box 46; therefore, the fasteners 70 and the bracket 20 do not need to be disturbed in order to remove the face plate.

The modular receiving portion 26 defines a connector receiving plane 74 which is at an angle $\alpha$ relative to the wall surface plane 72. By placing the modular receiving portion 26 at an angle $\alpha$, which is non-planar with the wall surface plane 72, the cable extending from the modular connector 60 is positioned to connect a short cable to the device such as a telephone shown in FIG. 5 at a better angle to minimize crimping of the cable. In the embodiment shown, the modular receiving portion 26 is at an angle $\alpha$ relative to the wall surface plane 72. The angle $\alpha$ shown in the FIG. 3 is 45 degrees. In addition, by having the connector receiving plane 74 intersect the wall surface plane above the modular connector, the modular connector jack 60 opens downward and therefore is less susceptible to airborne contamination such as dust or debris that can comprise signal integrity.

In an arrangement, the outlet box 46, the adapted cover 48, and the face plate 78 that the bracket 20 interacts with are industry standard sizes. The bracket 20 is compatibility with existing devices.

Figure 4:
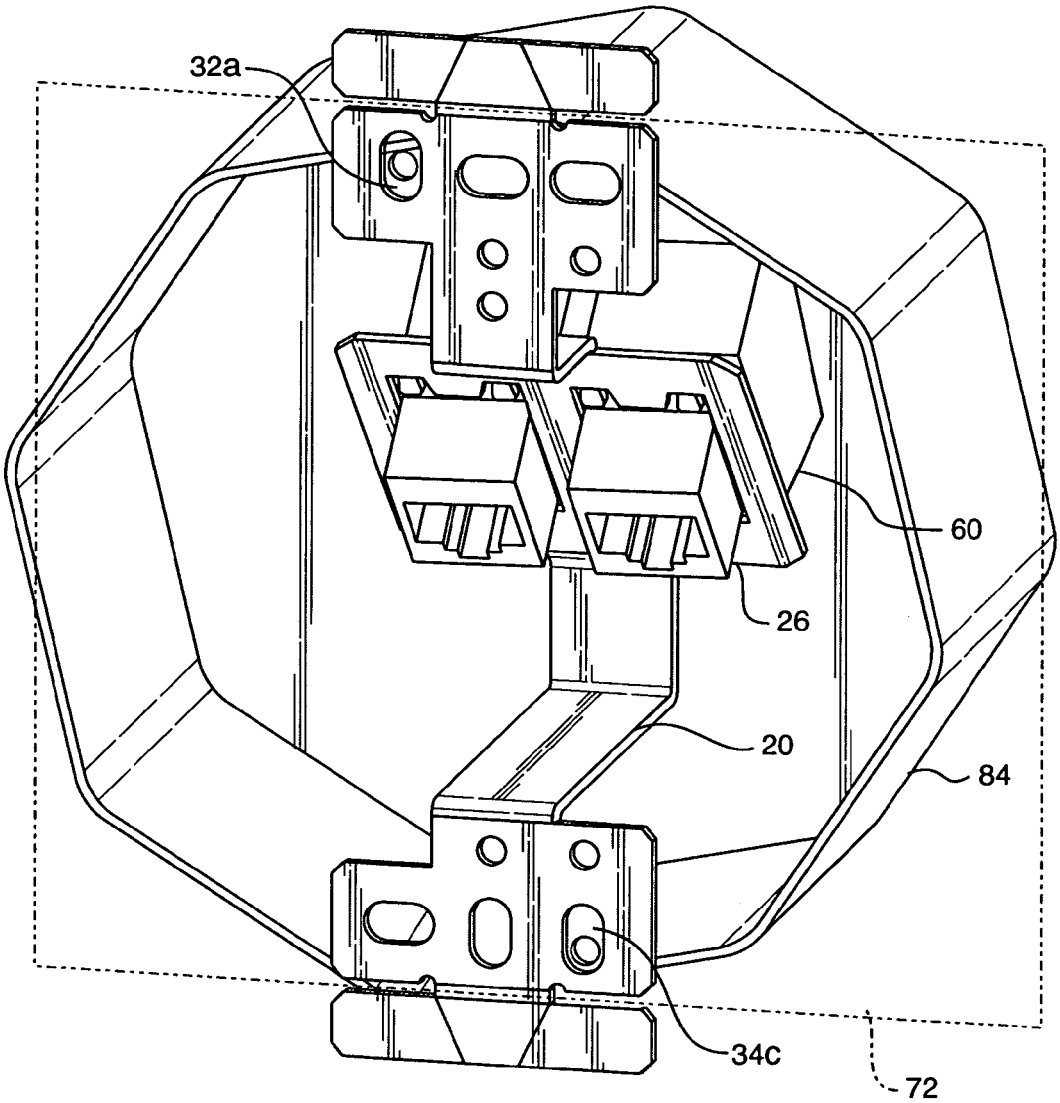
FIG. 4 is a perspective view of the bracket in an octagonal box.

Referring to FIG. 4, the bracket 20 is shown in an octangular outlet box 84. The mounting of the bracket 20 is similar to that shown above. However, a different set of mounting slots 32*a* and 34*c* are used to mount the bracket 20 to the box 84 than the slots 32*b* and 34*b* used in the outlet box 46 shown in FIG. 3. The various mounting slots 32 and 34 on the bracket 20 allow the bracket 20 to be mounted in various sized and configured outlet boxes. The mounting receiving portion 26 of the bracket 20 and the modular connectors 60 are located in the outlet box 84. With the modular connectors 60 and the mounting receiving portion 26 within the outlet box 84 and not projecting through the wall surface plane 72, a face plate or a device can placed over the bracket 20 and the modular connector 60 without the need to move or remove the bracket 20 and the modular connector 60 from their secured position.

Figure 5:
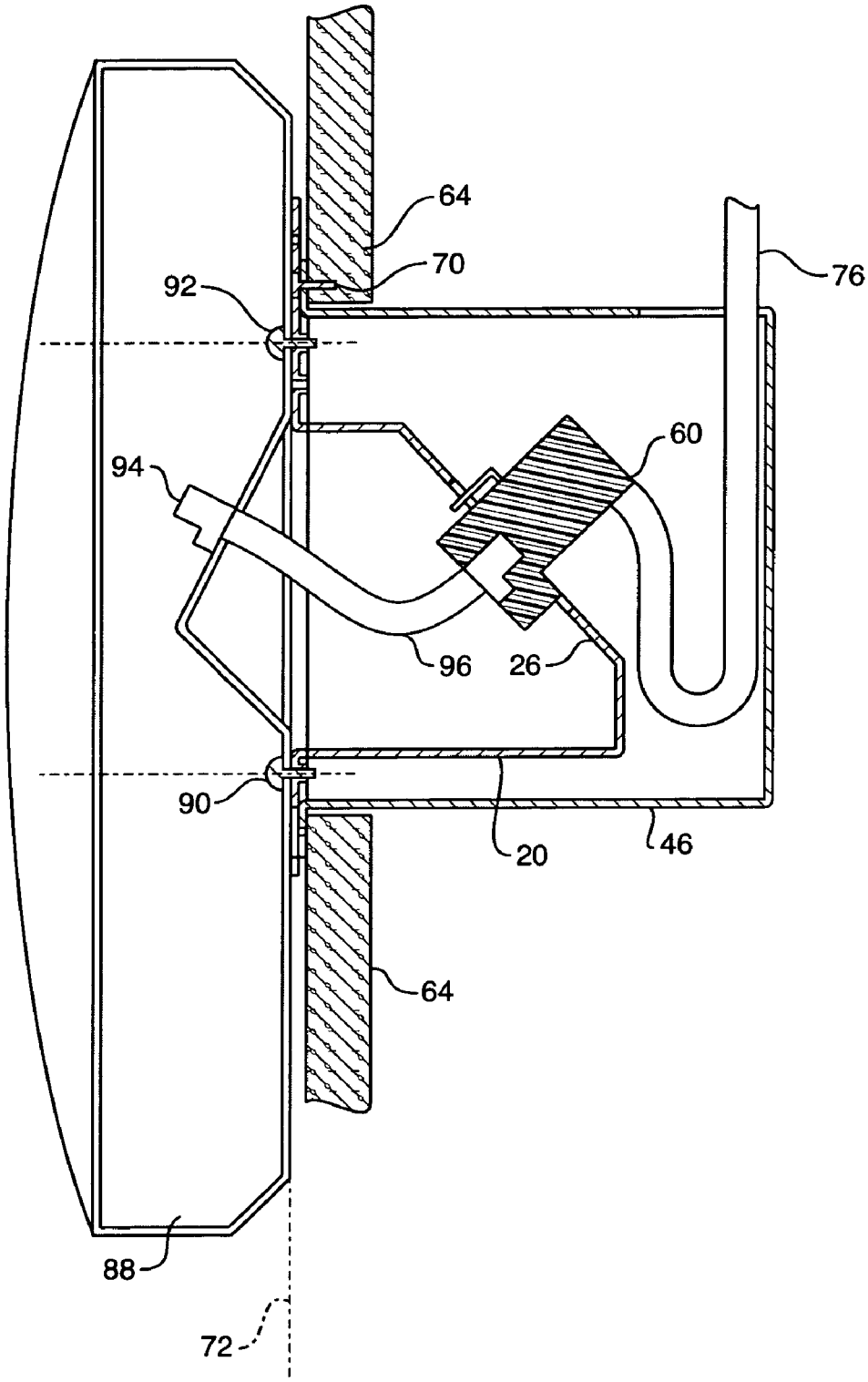
FIG. 5 is a side sectional view of a Voice over IP phone mounted to the wall.

It is recognized that various types of devices can be mounted to the wall 64 and overlie the outlet box 46 with the bracket 20. FIG. 5 is a side sectional view of a Voice over IP phone 88 as the device which is mounted to the wall 64. To install the phone 88 to the outlet box 46 shown in FIG. 3, the face plate 78, if covering the outlet box 46, is removed by removing the fasteners 80. Neither the bracket 20 nor the fasteners 70 that are used to secure the bracket 20 to the outlet box 46 are disturbed. A pair of mounting studs 90 are secured to the bracket 20. It is recognized that in the alternative, a phone face plate with a pair of mounting studs secured to the bracket 20 can be used in place of the pair of mounting studs 90 to secure the phone to the wall. The mounting studs 90 are received in the keyhole slots 92 located on the back of the phone 88 to hold the phone 88 to the wall 64. The phone 88 has a jack 94 for receiving one end of a short cable or patch cord 96 that is connected at the other end to the modular connector 60 carried by the modular receiving portion 26 of the bracket 20 and recessed in the outlet box 46. The angle of the modular receiving portion 26 relative to the wall surface plane 72 and the back of the phone 88 allows for a large radius bend of the cable 96. Since this configuration allows for a large bend radius, there is no tight bending of the cable 96 that could otherwise cause signal degradation.

Figure 6:
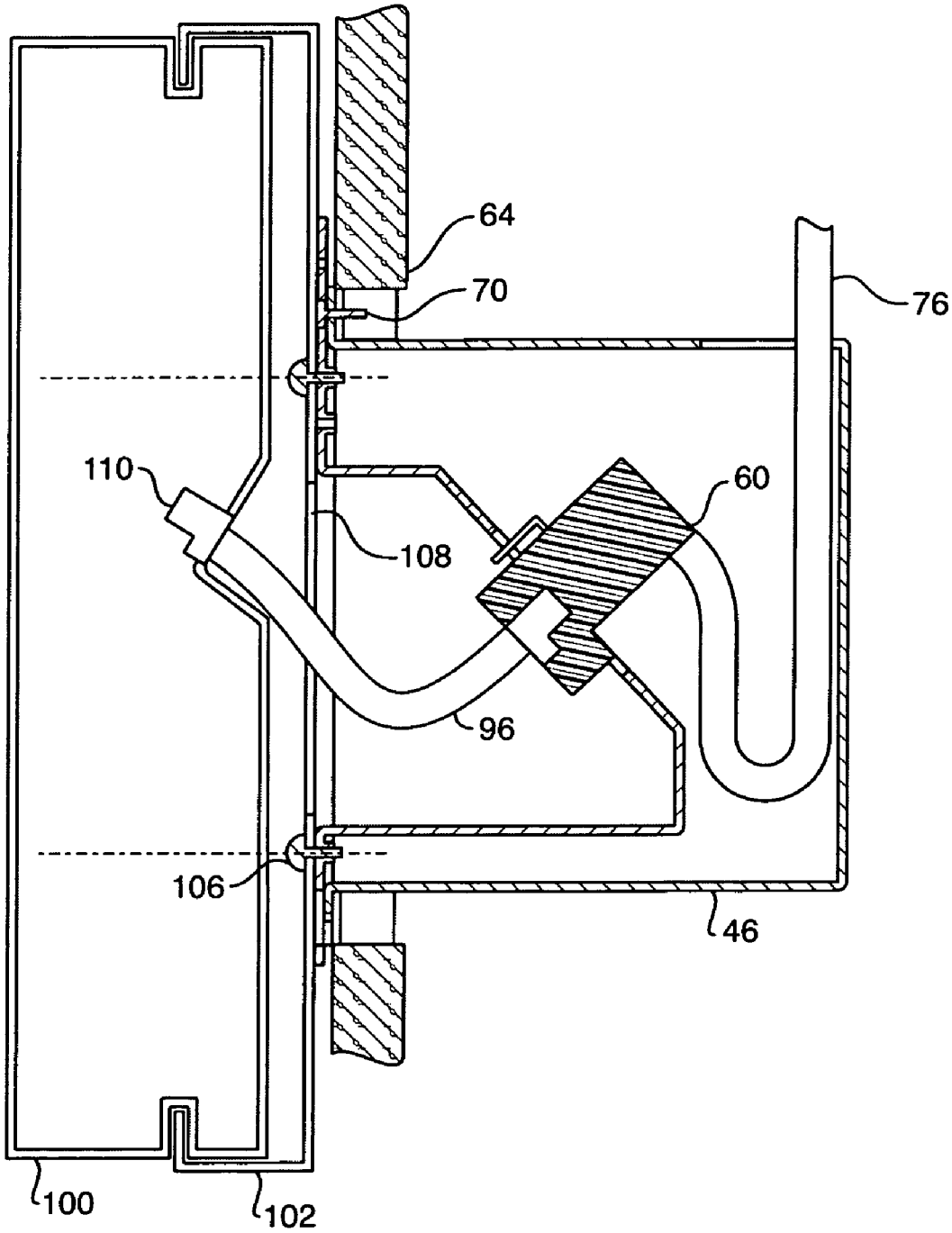
FIG. 6 is a side sectional view of a wireless router.

FIG. 6 is a side sectional view of the device being a wireless router 100 which is mounted to the wall 64 using a locking bracket 102. The locking bracket 102 both secures the wireless router 100 to the wall 64, i.e., the bracket 20, and prevents unauthorized access and disengaging of the patch cord 96. Similar to what is described above with respect to FIG. 5, the face plate 78, as seen in FIG. 3, is removed by removing the fasteners 80. Neither the bracket 20 nor the fasteners 70 that are used to secure the bracket 20 to the outlet box 46 are disturbed to remove the face place 78. The locking bracket 102 is secured to the bracket 20 with a pair of fasteners 106. The patch cord 96, which is connected to the modular connector 60, is fed through an opening 108 in the locking bracket 102 and connected to a jack 110 on the back of the wireless router 100. The wireless router 100 is secured to the locking bracket 102 thereby limiting access to the fasteners 106 that secure the locking bracket 102 to the wall 64, i.e., the bracket 20, and the patch cord 96.

In the embodiments shown in FIGS. 2–6, the modular connector 96 shown is a modular connector for receiving network cable such as CAT5 or CAT6 cable and accepting a RJ45 or RJ11 plug. In each embodiment described above, the bracket 20 positions the modular connector 60 within the outlet box 46 such that a face plate 78 can cover the bracket 20 with the modular receiving portion 26 holding the modular connector 60 without the necessity of moving or removing the modular connector from the fixed location.

Figure 7:
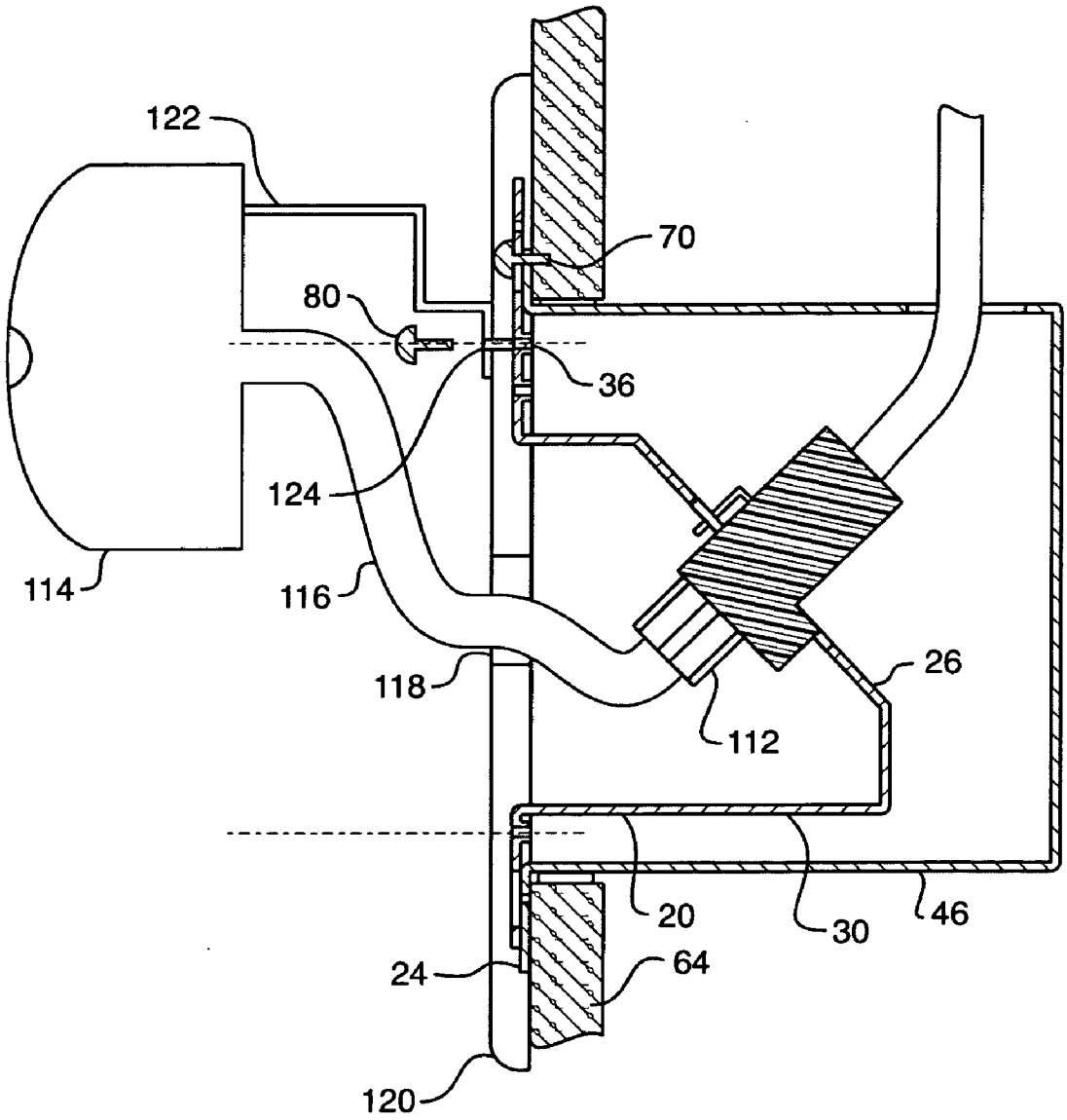
FIG. 7 is a side sectional view of the bracket with a coaxial cable for video camera.

Referring to FIG. 7, an alternative embodiment is shown where the bracket 20 has a co-axial cable jack 112 as part of the modular connector in contrast to the RJ45 jack. FIG. 7 is a side sectional view of the device being a camera 114, such as a security camera, which is mounted to the wall 64. To install the camera 114 to the outlet box 46, the face plate 78 such as shown in FIG. 3, if covering the outlet box 46, is removed by removing the fasteners 80. Neither the bracket 20 nor the fastener 70 that are used to secure the bracket 20 to the outlet box 46 are disturbed. A short patch co-axial cable 116 is secured to the co-axial cable jack 112. The short patch cord 116 is fed through an opening 118 in a specific face plate 120 and connected to the camera 114. The camera 114 has a bracket 122 that has a hole 124 that is aligned with one of the threaded holes 36 in the mounting portion 22 of the bracket 20. The fastener 80 extends through the hole 124 in the bracket and a hole on the face plate 120 and is received by the threaded hole 36 in the bracket 20. A second fastener 80 is received in a threaded hole 36 in the other mounting portion 24.

It is recognized that in some arrangements, the device such as a camera 114 may be mounted adjacent to and not connect directly through the box and the bracket. For example, the camera could be mounted directly to an adjacent stud. Even in arrangement where the device such as a camera is not secured to the bracket, the bracket still secures the modular connector. A face plate can be mounted over the modular connector. The face plate can be removed and replaced without disturbing the modular connector.

While this invention has been particularly shown and described with references to preferred embodiments thereof, it will be understood by those skilled in the art that various changes in form and details may be made therein without departing from the spirit and scope of the invention as defined by the appended claims.

While in the embodiments shown, only one type of connector is shown in each embodiment, it is recognized that multiple styles of connectors can be located in a single outlet box. For example, both network cabling connectors, such as a CAT5 or CAT6 RJ45, and a co-axial cable module connectors can be adjacent to each other in the rectangular openings 40 of the modular receiving portion 26. In addition, while two rectangular openings 40 are shown in the modular receiving portion 26, it is recognized that the modular receiving portion 26 can have various numbers of openings including 1, 2, and 4.

While in the arrangement shown in FIG. 4 has the outlet box 84 on a wall, it is recognized that the outlet box could located in other locations such as in the ceiling or on the floor. In addition, the bracket 20 can be mounted in a different orientation than vertical in the outlet box 84. While the term outlet box is used, it is recognized that the bracket can be used with a variety of industry-standard box configurations.

It is recognized that the bracket 20 can be formed of many types of materials. For example, the bracket 20 can be stamped from sheet metal. In the alternative, it can be formed from a hardened plastic.

What is claimed is:

1. A bracket for retaining a modular connector in relation to an outlet box, the bracket comprising:

a pair of mounting portions, each mounting portion having an opening for receiving a fastener for securing the bracket to the outlet box, the mounting portions defining a wall surface plane; and a modular receiving portion interposed between the pair of mounting portions, the modular receiving portion having at least one modular receiving opening to receive the modular connector, a plurality of breakable tabs extending into at least one modular receiving opening for adjusting the size of the opening for the modular connector, the modular receiving portion with the modular opening being spaced from the wall surface plane and located in the outlet box such that the modular connector is located within the outlet box.

2. A bracket of claim 1 wherein the opening for receiving a fastener of each mounting portion has a plurality of slots allowing movement of the bracket relative to the outlet box.

3. A bracket of claim 1 further comprising a pair of threaded openings for receiving a fastener for securing a device to the bracket and the outlet box.

4. A bracket of claim 1 further comprising at least one positioning portion interposed between one of the mounting portions and the modular receiving portion, the positioning portion projecting generally perpendicular to the mounting portion to space one end of the modular receiving portion inward from the wall surface plane.

5. A bracket of claim 1 wherein the modular receiving portion defines a receiving plane that intersects the wall surface plane at an angle of between 30 degrees and 60 degrees.

6. A bracket of claim 5 wherein the modular connector has a jack receiving opening and the receiving portion plane intersects the wall surface plane above the modular receiving opening with the jack receiving portion of the modular connector positioned to open downward relative to an upper portion of the outlet box to limit contamination from entering the jack receiving opening.

7. A bracket of claim 5 wherein at least one of the mounting portions further comprises a breakable tab for assisting in positioning the bracket relative to the outlet box and a wall.

8. A bracket for retaining a modular connector in relation to an outlet box, the bracket comprising a pair of mounting portions, each mounting portion having at least a pair of slots each capable of receiving a fastener in the alternative for securing to the outlet box, each mounting portion having a threaded opening for receiving a fastener for securing a device to the bracket and the outlet box, the mounting portions defining a wall surface plane;

a modular receiving portion interposed between the pair of mounting portions, the modular receiving portion having at least one modular receiving opening, the modular receiving portion defining a receiving plane that intersects the wall surface plane at an angle of between 30 degrees and 60 degrees, the receiving portion plane intersects the wall surface plane above the modular receiving opening, the modular receiving portion with the modular opening spaced from the wall surface plane and located in the outlet box such that the modular connector is located within the outlet box, the modular receiving portion further comprising a plurality of breakable tabs extending into at least one modular receiving opening for adjusting the size of the opening for the modular connector; and a pair of positioning portions, each positioning portion interposed between the mounting portion and the modular receiving portion for positioning the modular receiving portion relative to the mounting portion.

9. A mounting system for cable comprising:

an outlet box having a series of side walls and a pair of mounting flanges, each mounting flange having a threaded mounting hole, the mounting flanges defining a wall surface plane;

a bracket having a pair of mounting portions and a modular receiving portion, each mounting portion having an opening for receiving a fastener accepted by the threaded mounting hole of the mounting flanges of the outlet box; and a modular receiving portion interposed between the pair of mounting portions, the modular receiving portion having at least one modular receiving opening, the modular receiving portion further comprises a plurality of breakable tabs extending into at least one modular receiving opening for adjusting the size of the opening for the modular connector, the modular receiving portion with the modular opening being spaced from the wall surface plane and located in the outlet box such that the modular connector is located within the outlet box;

at least one modular connector, the modular connector being received in the modular opening space of the modular receiving portion of the bracket, the modular connector located within the outlet box; and a cable extending into the outlet box and connecting to the modular connector.

10. A mounting system of claim 9 wherein the modular receiving portion defining a receiving plane intersects the wall surface plane at an angle of between 30 degrees and 60 degrees.

11. A mounting system of claim 10 wherein the modular connector has a jack receiving opening and the receiving portion plane intersects the wall surface plane above the modular receiving opening with the jack receiving portion of the modular connector positioned to open downward relative to an upper portion of the outlet box to limit contamination from entering the jack receiving opening.

12. A mounting system for cable comprising:

an outlet box having a series of side walls and a pair of mounting flanges, each mounting flange having a threaded mounting hole, wherein the opening for receiving a fastener of each mounting portion has a plurality of slots allowing movement of the bracket relative to the outlet box, the mounting flanges defining a wall surface plane;

a bracket having a pair of mounting portions and a modular receiving portion, each mounting portion having an opening for receiving a fastener accepted by the threaded mounting hole of the mounting flanges of the outlet box; and a modular receiving portion interposed between the pair of mounting portions, the modular receiving portion having at least one modular receiving opening, the modular receiving portion with the modular opening being spaced from the wall surface plane and located in the outlet box such that the modular connector is located within the outlet box; and at least one modular connector, the modular connector being received in the modular opening space of the modular receiving portion of the bracket, the modular connector located within the outlet box.

13. A mounting system of claim 12 wherein the modular receiving portion defines a receiving plane intersecting the wall surface plane at an angle of between 30 degrees and 60 degrees, further comprising:

a pair of threaded openings, each for receiving a fastener for securing a device to the bracket and the outlet box; and a cable extending into the outlet box and connecting to the modular connector;

wherein the fasteners for securing the device to the bracket are a pair of mounting studs adapted to be received by the device.

14. A mounting system of claim 13 wherein the device is a wireless router.

15. A mounting system of claim 13 wherein the device is a camera.

16. A mounting system of claim 13 wherein the fasteners for securing the device to the bracket are a pair of mounting studs adapted to be received by the device.

17. A mounting system of claim 13 wherein the device is a telephone.

18. A mounting system of claim 17 wherein the telephone is a voice over IP telephone.

19. A mounting system of claim 17 wherein the telephone is a plain old telephone service (POTS) telephone.

* * * * *